United States Patent [19]

Shinyashiki

[11] Patent Number: 4,724,460

[45] Date of Patent: Feb. 9, 1988

[54] COPYING DEVICE

[75] Inventor: Shinobu Shinyashiki, Yokohama, Japan

[73] Assignee: Kabushiki Kaisha Toshiba, Kawasaki, Japan

[21] Appl. No.: 879,293

[22] Filed: Jun. 27, 1986

[30] Foreign Application Priority Data

Jun. 28, 1985 [JP] Japan ..... 60-141669
Jun. 28, 1985 [JP] Japan ..... 60-141667
Mar. 29, 1986 [JP] Japan ..... 61-69748

[51] Int. Cl.[4] ..... G03G 15/00

[52] U.S. Cl. ..... 355/14 SH; 355/3 SH; 355/14 CU

[58] Field of Search ..... 355/14 SH, 14 CU, 14 R, 355/3 SH, 3 R, 23, 24; 271/186, 236, 245, 251, 3, 3.1, 4

[56] References Cited

U.S. PATENT DOCUMENTS 4,190,354 2/1980 Smith et al. ..... 355/24 X
4,317,629 3/1982 Kuseski ..... 355/24
4,451,138 5/1984 Anderson ..... 355/24 X
4,477,068 10/1984 Arter et al. ..... 355/14 SH X
4,508,447 4/1985 Doery ..... 355/24 X
4,515,464 5/1985 Shigemura et al. ..... 355/14 CU X
4,521,102 6/1985 Motomura et al. ..... 355/14 CU

*Primary Examiner*—A. C. Prescott
*Attorney, Agent, or Firm*—Schwartz, Jeffery, Schwaab, Mack, Blumenthal & Evans

[57] ABSTRACT

A copying device according to the present invention includes a manuscript supply unit for supplying the manuscripts to be copied in an automatic or a semi-automatic fashion, a two-sided and a multiple copying mechanisms that supply the copying papers again to the image copying unit, for carrying out a two-sided copying and a multiple copying, a detection device which detects the number of sheets of the manuscripts to carry out a two-sided copying or a multiple copying, and a microcomputer that is programmed so as to forbid the copying operation when the number of sheets of the copying papers to be collected in a temporary collecting unit that is determined by multiplying the number of sheets detected by said detecting means with a set number of sheets of copies to be taken, exceeds a predetermined allowed collecting number of sheets in the temporary collecting unit. This microcomputer is programmed so as to output a control signal to the manuscript supply unit to supply the manuscripts semi-automatically when a two-sided copying or a multiple copying is to be carried out.

26 Claims, 15 Drawing Figures

COPYING DEVICE

BACKGROUND OF THE INVENTION

1. Field of the Invention

The present invention relates to a copying device which is capable of carrying out copying on both surfaces of a copying paper or a multiple copying on one surface of the copying paper, in particular to a copying device which can prevent a jamming of papers in both surface copying or a multiple copying.

2. Description of the Prior Art

In a copying device for carrying out a copying on both sides of the copying paper (referred to as the two-sided copying hereinafter) or a multiple copying on the same side of the copying paper, it is at least necessary, after temporarilly collecting the copying papers that were once subjected to the copying process in an internal temporary collecting unit or the like, without ejecting them immediately to the outside, to feed them back again to the image copying unit, by turning them over, in the case of two-sided copying, in order to prepare the reverse sides to another copying, and to feed them without turning them over, in the case of multiple copying, in order to prepare the same sides to the copying of another image. However, the capacity of the temporary collection is limited naturally subject to the overall size of the copying device, limiting the number of sheets of copying papers that can be collected in the temporary collecting unit. For this season, if the copying papers are collected in the temporary collecting unit beyond the limited number of sheets, them the copying device will give rise to a paper jamming.

Now, there are two ways by which manuscripts can be supplied to the copying device. Namely, one is due to automatic supply function in which a sheet out of a plurality of sheets of manuscript that are placed on the manuscript stand is supplied sheet by sheet completely automatically, while the other is due to semi-automatic function in which out of a plurality of sheets of manuscript that are placed on the manuscript stand one sheet is supplied for each operation of the start button, the machine stops after completion of copying of each page of manuscript, and requires another operation of the start button for the next supply and copying of the manuscript page. In carrying out two-sided copying or multiple copying by the use of a copying device that is equipped with such an automatic and a semi-automatic supply functions, if the manuscripts are supplies automatically by means of, for example, the automatic supply function, it may happen that there are collected in the temporary collecting unit copying papers that exceed the number of sheets that can be accomodated, as a result of colection of the copying papers that copied all of the pages of the manuscripts placed on the manuscript stand, regardless of the number of copying papers collectable in the temporary collecting unit, which leads to the problem that gives rise to a jamming of the papers. In addition, when the manuscripts are supplied by the automatic supply function, the manuscripts will be supplied continuously one page after another so that there is also a problem that two-sided copying or multiple copying that is desired by the operator may find it difficult to be achieved freely for each copying.

SUMMARY OF THE INVENTION

An object of the present invention is to provide a copying device which is capable of surely preventing the paper jamming in a two-sided copying or a multiple copying that may be caused due to collection of copying papers to a number which exceeds the allowable number of sheets in the collecting unit.

Another object of the present invention is to provide a copying device which is capable of restricting the supply of the manuscripts in the two-sided copying or multiple copying to the semi-automatic mode.

In a copying device which has a manuscript supply unit that carries out copying operation while supplying the manuscripts to be copied in an automatic or semi-automatic manner, and two-sided and multiple copying mechanisms that supply the copying papers, for two-sided and multiple copyings, again to the image copying unit after they are collected in a temporary collecting unit, the present invention is characterized in that the copying device comprises, for carrying out two-sided copying or multiple copying, a detecting means which detects the number of manuscript pages, an operating means which computes the number of copying papers to be collected in the temporary collecting unit by multiply the number of manuscript pages detected in the detecting means with a prescribed number of copies to be taken, and a control means which restricts the copying operation to be forbidden if the number of copying papers computed by the computing means exceeds a predetermined allowable number of papers that can be collected in the temporary collecting unit. Further, the control means controls the manuscript supply unit so as to supply the manuscripts semi-automatically when two-sided or multiple copying is to be carried out.

In a copying device which has a manuscript supply unit that carries out copying operation while supplying the manuscripts to be copied in an automatic or semi-automatic manner, and two-sided and multiple copying mechanisms that supply the copying papers, for two-sided and multiple copyings, again to the image copying unit after they are collected in a temporary collecting unit, the present invention is characterized by another fact that the copying device comprises a means for detecting the number of sheets of the copying papers that are transported to the temporary collecting unit and a control means which controls the copying operation to be forbidden when the number of sheets of the copying papers that are to be transported to the temporary collecting unit exceeds a prescribed number of sheets that is obtained by subtracting a marginal number of sheets from the allowable number of sheets for the temporary collecting unit.

These and other objects, features and advantages of the present invention will be more apparent from the following description of the preferred embodiments, taken in conjunction with the accompanying drawings.

DESCRIPTION OF THE PREFERRED EMBODIMENTS

Figure 1:
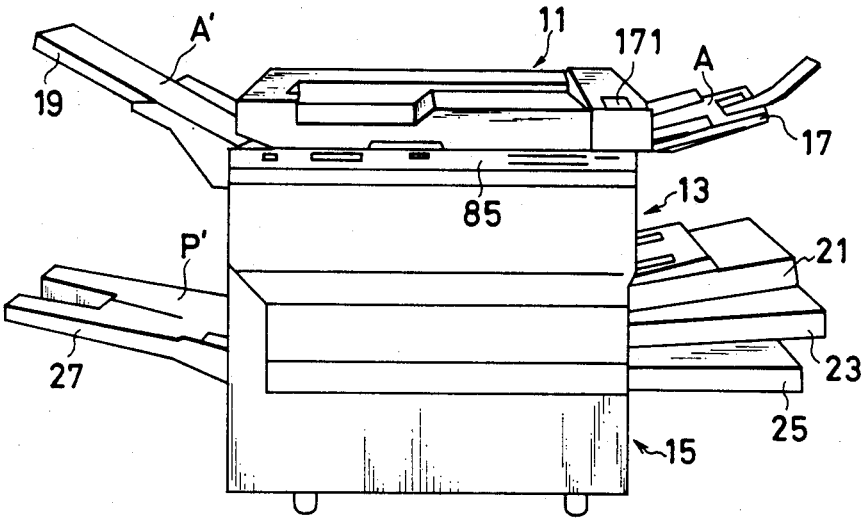
FIG. 1 is a perspective view for showing an overall external view of a copying device that is embodying the present invention.
Figure 2:
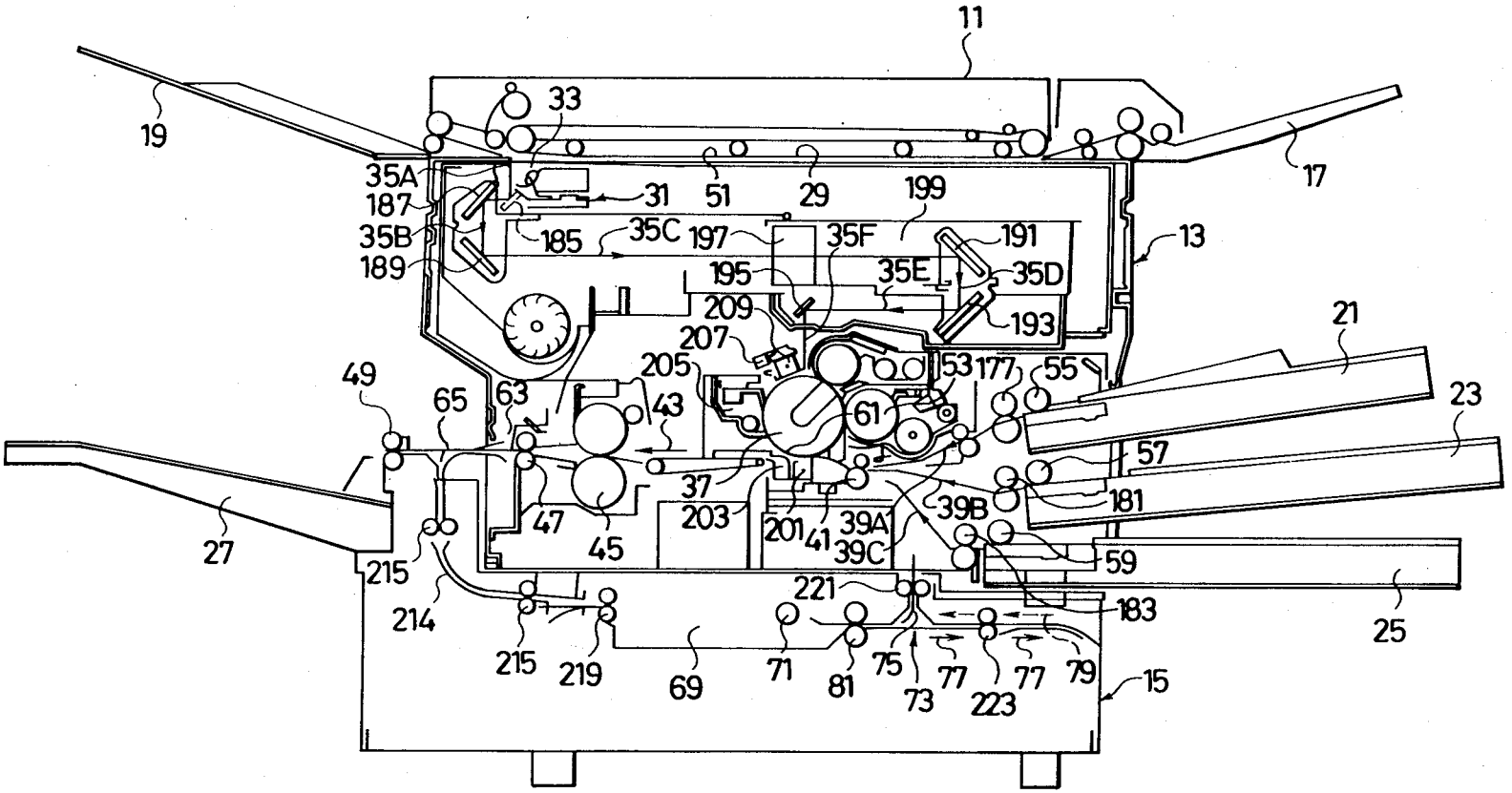
FIG. 2 is a sectional view for illustrating the whole internal structure of the copying device shown in FIG. 1.

Referring to FIGS. 1 and 2 a copying device embodying the present invention is shown. The copying device comprises an automatic manuscript supply unit 11 which supplies automatically the manuscripts to be copied, a copying unit 13 which is arranged beneath the automatic manuscript supply unit 11 and makes copies of manuscripts supplied by the automatic manuscripts supply unit 11, and a direction converting transportation unit 15 which is arranged at the lowest position beneath the copying unit 13 and, after temporarily collecting the copying papers copied in the copying unit 13 for two-sided copying and multiple copying, supplies these papers again to the copying unit 13 with or without turning over. On one side, namely, on the right side, of the automatic manuscript supply unit 11, there is attached a manuscripts stand 17 on which are placed manuscripts A, and on the other side of the automatic manuscripts supply unit 11 there is provided a first manuscript ejecting unit 19 to which are ejected manuscripts A' whose copies were taken. In addition, below one side, namely, the side on which is provided the manuscript stand 17, of the copying unit 13, there are mounted three paper feeding cassettes 21, 23, and 25 which house copying papers with three different sizes to be supplied to the copying unit 13, and on the other side there is provided an ejected paper tray 27 which houses copying papers for which copying was completed and are ejected, and the copying papers P' which went through copying are placed on the ejected paper tray 27.

FIG. 2 is a sectional view which illustrates schematically the internal structure of the ocupying device shown in FIG. 1.

Describing the copying device briefly by referring to the figure, a manuscript A that was placed on the manuscript stand 17 of the automatic manuscript supply unit 11 is placed, by means of a plurality of rollers and belts, on a manuscript placing surface 29 formed of a transparent manuscript placing glass 51 which is located at the center on the bottom surface of the automatic manuscript supply unit 11. In the copying unit 13 directly below the manuscript placing surface 29 there is arranged a manuscript illuminating unit 31, and a scanning lamp 33 provided in the menuscript illuminating unit 31 for illuminating manuscripts illuminates, via the manuscript placing glass 51, the manuscript A that is placed on the manuscript placing surface 29 to read the image on the manuscript A. That is, the light reflected from the manuscript A which is illuminated by the scanning lamp 33 proceeds downward as shown by the arrow 35A. Then, via an exposure optical system 199 that consists of a plurality of reflecting mirrors 185, 187, 189, 191, 193, and 195 and a lens 197, the light proceeds following the arrows 35B, 35C, 35D 35E, and 35F to illuminate a photosensitive drum 37 with relatively large diameter that is arranged approximately at the middle of the copying unit 13, to form an electrostatic latent image of the manuscript A on the photosensitive drum 37.

The electrostatic latent image formed on the photosensitive drum 37 is developed in the developing device 53 while the drum is rotated in the clockwise direction in the figure, and is transferred to the copying paper P that is provided by the paper supply cassette 21, 23, or 25. Namely, the copying paper P that is housed in the paper supply cassette 21, 23, or 25 is taken out by means of roller 55, 57, or 59 to be transported via a plurality of rollers 177, 181, and 183 as shown by the arrows 39A, 39B, and 39C. Further, via aligning rollers 41, the copying paper is passed through a transfer unit 61 that is formed on the lower side of the photosensitive drum 37 between the transfer charger 201 to transfer the electrostatic latent image formed on the photosensitive drum 37 to be transferred to the first surface, that is, the upper surface in the figure, of the copying paper P. Then, via a detaching charger 203, through a main transporting route 43 shown by an arrow 43, the transferred image is fixed by going through a fixing unit 45 consisting of a pair of drums, and the copying paper is ejected from an ejecting unit 63 by means of the ejecting rollers 47. Here, the past of the photosensitive drum 37 that passed through the detaching charger 203 goes through a cleaning unit 205, a charge removal lamp 207, and an electrical charger 209 in succession, to be charged again to a prescribed potential by the corona discharge from the electrical charger 209. Then, it is made ready to form an electrostatic latent image of another manuscript A on the photosensitive drum 37 through exposure to light again in the exposure optical system 199.

The copying paper P' that is ejected from the ejecting unit 63 via the main transporting route 43 of the copying unit 13 is ejected to the ejected paper tray 27 via auxiliary rollers 49 of the direction converting transportation unit 15. However, if the copying paper is to have a two-sided copying or a multiple copying, the copying paper P' is sent, instead of being ejected directly to the ejected paper tray 27 via the auxiliary rollers 49, into a first turning back route 67 which is a re-supply transporting route 67 that extends downward, by means of a first sorting gate unit 65 provided between the ejecting unit 63 and the auxiliary rollers 49. In this manner, the copying paper P' is collected temporarily in a temporary collecting unit 69 provided beneath about the center of the direction converting transportation unit 15 by means of a plurality of transporting rollers and transporting guides that are provided in the re-supply transporting route 67.

The copying papers P' collected in the temporary collecting unit 69 are supplied to a second sorting gate unit 73 via bringing-in rollers 81 after they are taken out by a take-out roller 71. A copying paper P' is sent either into a second turning back route 75 which extends upward from the gate section as shown by the arrow 75 or into a front-back conversion route 77 which extends horizontally as shown by the arrows, by the control of the second sorting gate unit 73.

A copying paper P' which is sent upward into the second turning over route 75 from the second sorting gate unit 73, after being multiply copied on the same first surface of the copying paper P', by passing through the transfer unit 61 which is located below the photosensitive drum 37 for a second time, along the main transporting route 43 via the fixing unit 45, the ejecting rollers 47, and the auxiliary rollers 49 to be ejected to the ejected paper tray 27. On the other hand, a copied paper P' which is sent horizontally into the front-back conversion route 77 from the second sorting gate unit 73 is transported, after its rear end clears the second sorting gate unit 73, is transported in the the direction opposite to the direction of transportation before that time, as indicated by the arrows in dotted lines. Then, under the control of the second sorting gate unit 73, the rear end of the copied paper P' is transported upward from the second sorting gate unit 73 to the second turning over route 75. By this operation, the front and the back of the copied paper P' are inverted so that the copied paper P' passes through the transfer unit 61 with its second surface facing the photosensitive drum 37, to have a copying on its second surface, that is, to accomplish a two-sided copying. Then, via the main transporting route 43, the fixing unit 45, ejecting rollers 47, and the auxiliary rollers 49, it is ejected to the ejected paper tray 27. In this manner, after the copied papers P' for two-sided copying or multiple copying are collected temporarily in the temporary collecting unit 69, they are supplied again to the transfer unit 61 from the second turning over route 75, with either front-back inversion or without inversion, under the control of the second sorting gate unit 73, accomplishing two-sided copying or multiple copying.

Figure 9:
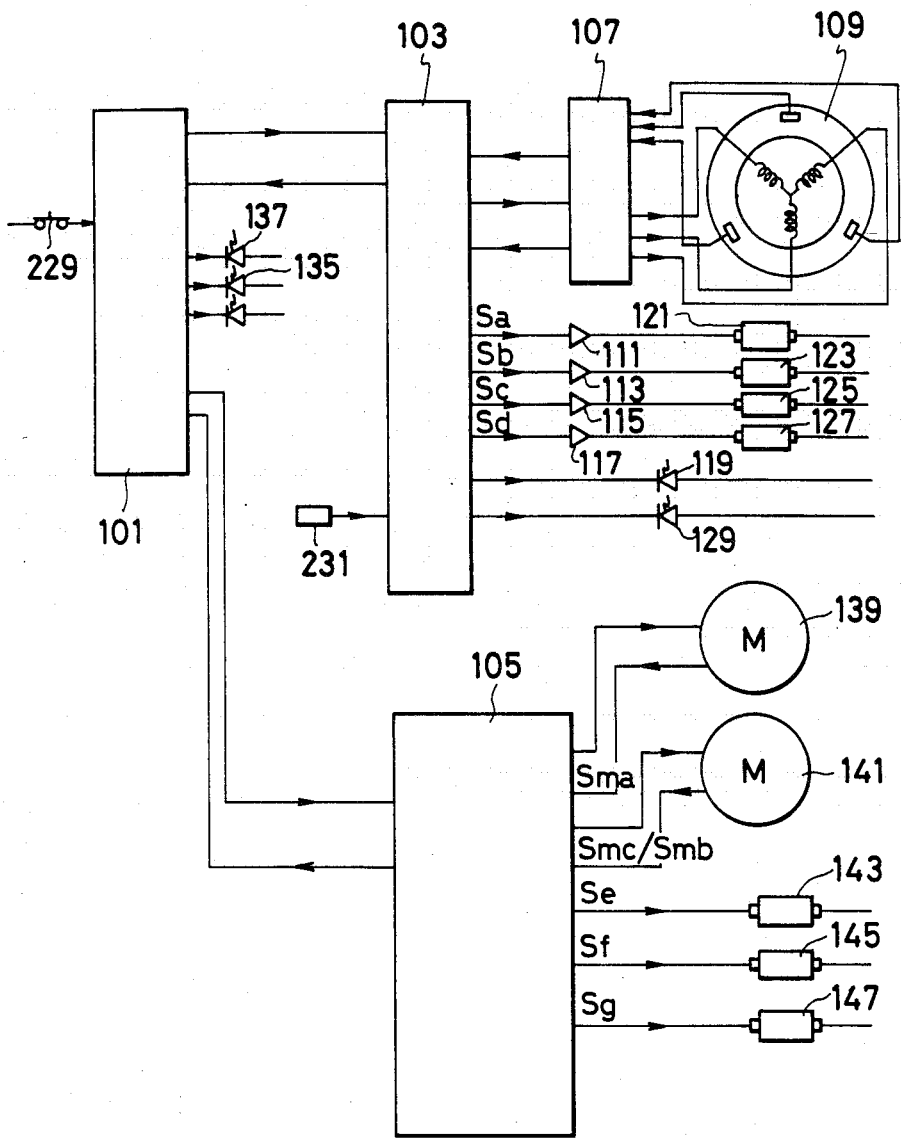
FIG. 9 is a circuit diagram for the copying device shown in FIG. 2.

As shown in FIG. 9 which illustrates a circuit diagram for controlling the operation of the copying device shown in FIG. 1, the present copying device has a microcomputer 101 which carries out overall control, a microcomputer 103 which controls the operation of the automatic manuscript supply unit 11, and a microcomputer 105 which controls the operation of the direction converting transportation unit 15.

Figure 3:
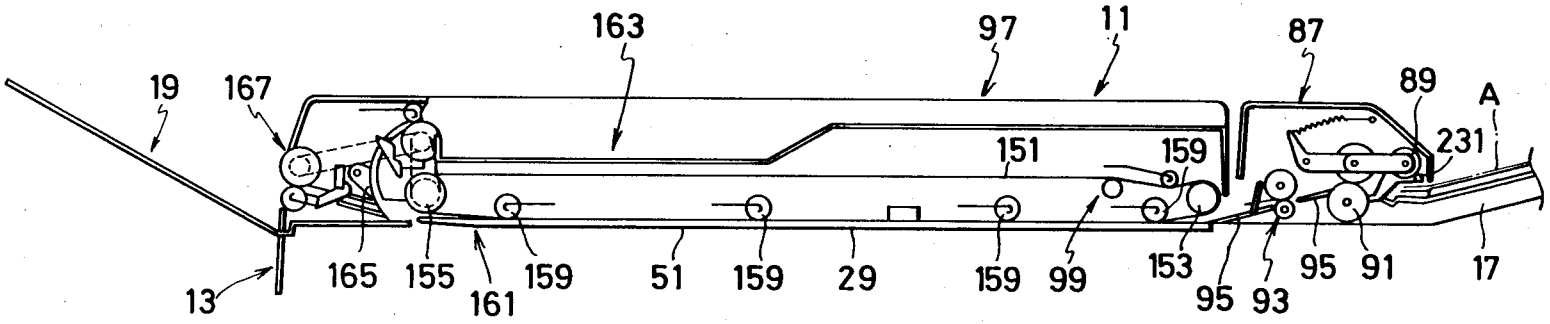
FIG. 3 is a sectional view for illustrating a detailed internal structure of the automatic manuscript supply unit of the copying device shown in FIG. 2.
Figure 4:
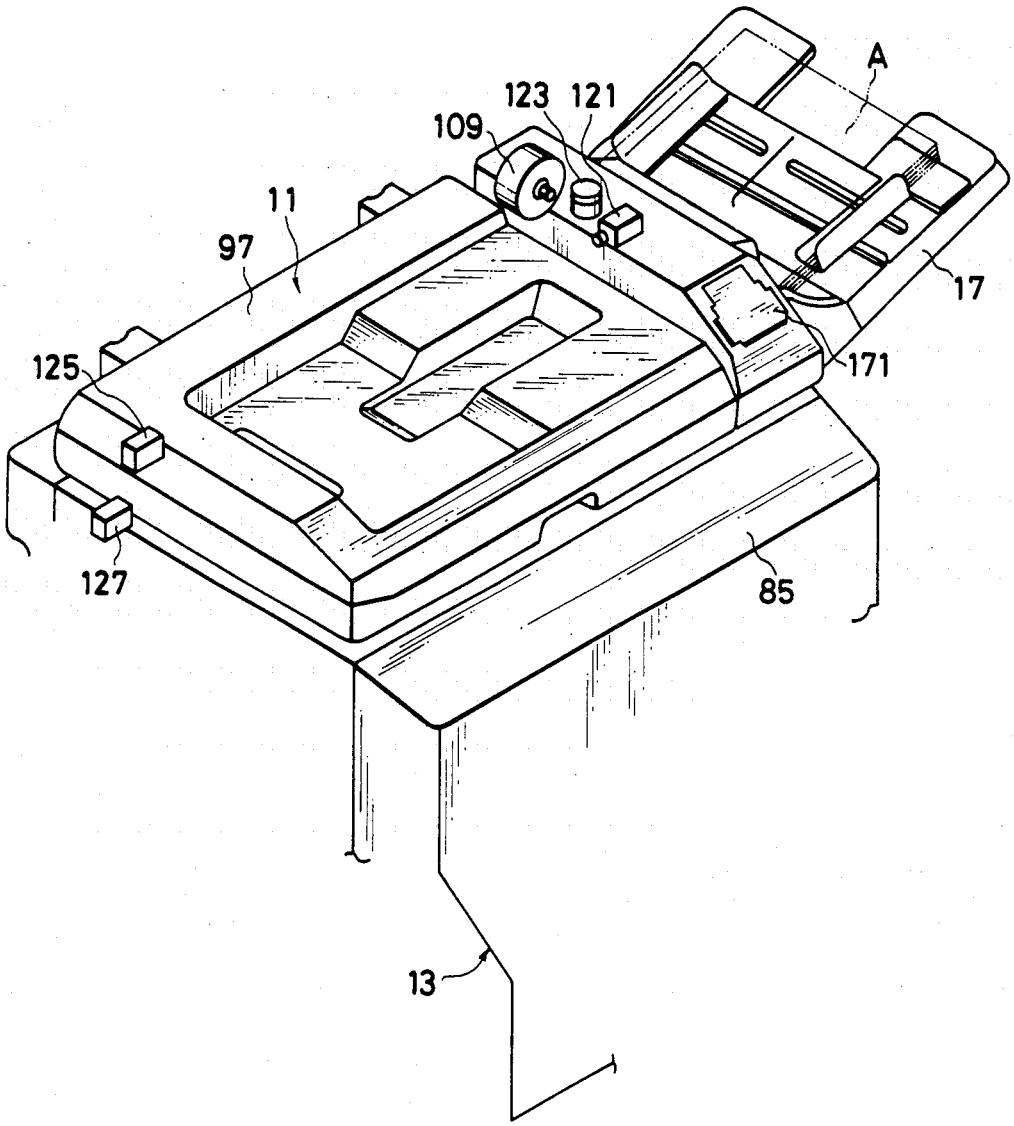
FIG. 4 is a perspective view of the automatic manuscript supply unit.

FIG. 3 is a sectional view for illustrating the details of the automatic manuscript supply unit 11. In the figure, manuscript A consisting of a plurality of sheets that are placed on the manuscript stand 17 is transportated one sheet at a time by manuscript supply unit 87. Namely, a take-out rollers 89 that is provided in ths manuscript supply unit 87 is driven so as to establish a contact with the manuscript A by a feed paper solenoid 121 that is driven by a feed paper solenoid driving signal $S_a$ that is output from the microcomputer 103 via a buffer 111 as shown in FIG. 9, and supplies the manuscript A taken from the topmost sheet of the pile one sheet at a time to the interior of the automatic manuscript supply unit 11. The manuscript A which is taken out sheet by sheet by the take-out roller 89 is supplied to a manuscript transportation and collection unit 97 via feed rollers 91, relay rollers 93, and guiding members 95. The manuscript transporting and collecting unit 97 has a manuscript transportation device 97 consisting of a conveyor belt 151, a driving pulley 153, a subordinate pulley 155, a plurality of pressing rollers 157 and tension rollers 159, and others, for transporting the manuscript A supplied by the manuscript supply unit 87 to a prescribed position in the manuscript placing surface 29. The manuscript transporting device 9 is actuated when the conveyor belt driving solenoid 123 is driven and brought to the attracted state by the conveyor belt driving signal $S_b$ that is output from the microcomputer 103 via a buffer 113, as shown in FIG. 9, and transports the manuscript A that is supplied by the manuscript supply uni 87 to a prescribed position on the manuscript placing surface 29. Further, on the rear end side near the subordinate pulley 155 of the manuscript transporting and collecting unit 97 there is provided a stopper 161 which stops the manuscript A at a prescribed position. The stopper 161 is controlled by a stop solenoid 127 which is driven by a stop solenoid controlling signal $S_d$ that is output by the microcomputer 103 via a buffer 117, as shown in FIG. 9, to stop the manuscript A at a prescribed position on the manuscript placing surface 29. Moreover, the feed paper solenoid 121, the conveyor belt driving solenoid 123, and the stop solenois 127 are provided near the center of the manuscript supply unit 87 of the automatic manuscript supply unit 11 and near the rear end of the manuscript transporting and collecting unit 97, respectively, as shown in FIG. 4. In addition near the feed paper solenoid 121 and the conveyor belt driving solenois 123 there is provided a driving motor 109, as shown in FIG. 4. The driving motor 109 which is for driving to rotate the take-out roller 89, the feed rollers 91, the relay rollers 93, the driving pulley 153, and others is driven by the microcomputer 103 via the collecting device 107, as shown in FIG. 9.

Further, in FIG. 4, a switching solenoid is provided in the vicinity of the stop solenois 127. The switching solenoid 125 is driven by a switching solenois driving signal $S_o$ output by the microcomputer 103 via a buffer 115. The switching solenoid 125 controls, when the manudscript A is ejected, after transported to the manuscript placing surface 29 of the manustript transporting and collecting unit 97 and copying is made, by the manuscript transporting device 99, whether the manuscript be ejected to the first manuscript ejecting unit 19 or it be ejected to a second manuscript ejecting unit 163 that is formed above the manuscript transporting device 99. That is, as shown in FIG. 3, on the downstream side of and in the vicinity of the subordinate pulley 155 of the manuscript transporting device 99, there is provided a switching gate 165 that is controlled by the switching solenoid 125. By controlling the opening and closing of the switching gate 165, the manuscript A that is ejected from the manuscript placing surface 29 by the manuscript transporting device 99, can be ejected either to the first manuscript ejecting unit 19 via the ejecting rollers 167 that consist of a driving roller and a pressing roller that are provided in the downstream in the horizontal direction or to the second manuscript ejecting unit 163 via the second ejecting rollers 169 that consist of a driving roller and a pressing roller that are provided above the switching gate 165.

As a result, when the manuscripts A are ejected to the first manuscript ejecting unit 19 under the control of the switching gate 165, the disposition of the manuscripts A will be reverse of the disposition when they were placed on the manuscript stand 17. However, when they are ejected to the second manuscript ejecting unit 163, the manuscripts A were inverted by the turning over route that consists of a second ejecting roller 169, and hence, the disposition of the manuscripts A will be the same as that when they were placed on the manuscript stand 17, so that it is convenient without requiring the labor for reinstating the original order of the manuscripts A after the completion of copying.

On the other hand, in FIG. 3, 231 is a manuscript detection means which outputs a signal that corresponds to the thickness of the number of sheets of the manuscripts A that are placed on the manuscript stand 17, and its output is connected to the microcomputer 103 as shown in FIG. 9. Further, in the present embodiment, the manuscript detecting means 231 consists of a switch that is arranged above the entrance to the manuscript supply unit 87, and outputs a signal that corresponds to the thickness of the manuscripts that are placed on the manuscript stand 17. With this arrangement, in a two-sided copying or a multiple copying that makes use of the temporary collecting unit 69, the microcomputer 103 reads the state of the manuscript detecting means 231. When the thickness of the manuscripts reaches a predetermined thickness that corresponds to the allowable sheets of collection in the temporary collecting unit 69, the microcomputer 103 forbids the starting of copying operation by judging that there is a fear that a jamming of the papers may be generated in copying. Further, when the thickness of the manuscripts does not reach the predetermined thickness, the microcomputer 103 receives further a signal on the number of sheets to be copied for two-sided copying or multiple copying that is set by the operating button in the operating unit 85 and a signal from the manuscript detecting means, and computes the number of sheets for the case when copying is to be made for respective number of pages set for each of the manuscripts A that are placed on the manuscript stand 17. Then, the computed number of sheets is compared with the prescribed maximum number of sheets that are collectable in the temporary collecting unit 69. If the computed number of sheets exceeds the prescribed maximum number of sheets, the microcomputer 103 outputs a signal that forbids the starting of copying to forbids the starting of copying. Here, the manuscript detecting means does not have to be a switching means, as was the case in the above, and anything will do if it determine the number of sheets of the manuscripts A that are in the condition of placement.

Figure 8:
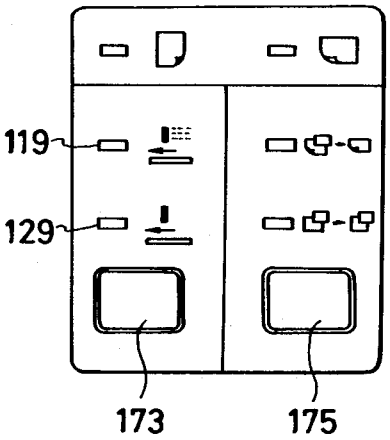
FIG. 8 is a plan view for illustrating the operating unit of the automatic manuscript supply unit for the copying device shown in FIG. 1.

Further, in FIG. 4, on the sloped section on a side of the manuscript supply unit 87 of the automatic manuscript supply unit 11, there is provided an operating unit 191. The operating unit 171 has, as its detail is shown in FIG. 8, a semi-automatic feeding button 173, and automatic feeding button 175, a light-emitting diode 119 for displaying automatic feeding operation, and a light-emitting diode 129 for displaying semi-automatic feeding operation. As shown in FIG. 9, the light-emitting diode 119 for displaying automatic feeding operation is driven by the microcoomputer 103 and display is presented by lighting it up. Namely, the automatic manuscript supply unit 11 has an automatic manuscript supply mode (called the ADF mode hereinafter) in which after a plurality of manuscripts A that are placed on the manuscript stand 17 are supplied on the manuscript placing surface 29 and copies are taken one by one entirely automatically, the manuscripts A are ejected successively to either the first manuscript ejecting unit 19 or the second manuscript ejecting unit 163, and a semi-automatic manuscript supply mode (called the SDF mode hereinafter) in which after one sheet of the manuscripts A that are placed on the manuscript stand 17 is supplied on the manuscript placing surface 29 and copying is made, the operation is interrupted wihtout supply of another manuscript A on the manuscript placing surface 29, staying stationary until the next start operation is indicated. The light-emitting diode 119 for displaying automatic feeding operation and the light-emitting diode 129 for semiautomatic feeding operation are the display means for displaying the ADF and the SDF modes, respectively. The automatic feeding button 175 and the semi-automatic feeding button 173 are the operating buttons for indicating the ADF mode and the SDF mode, respectively.

Figure 5:
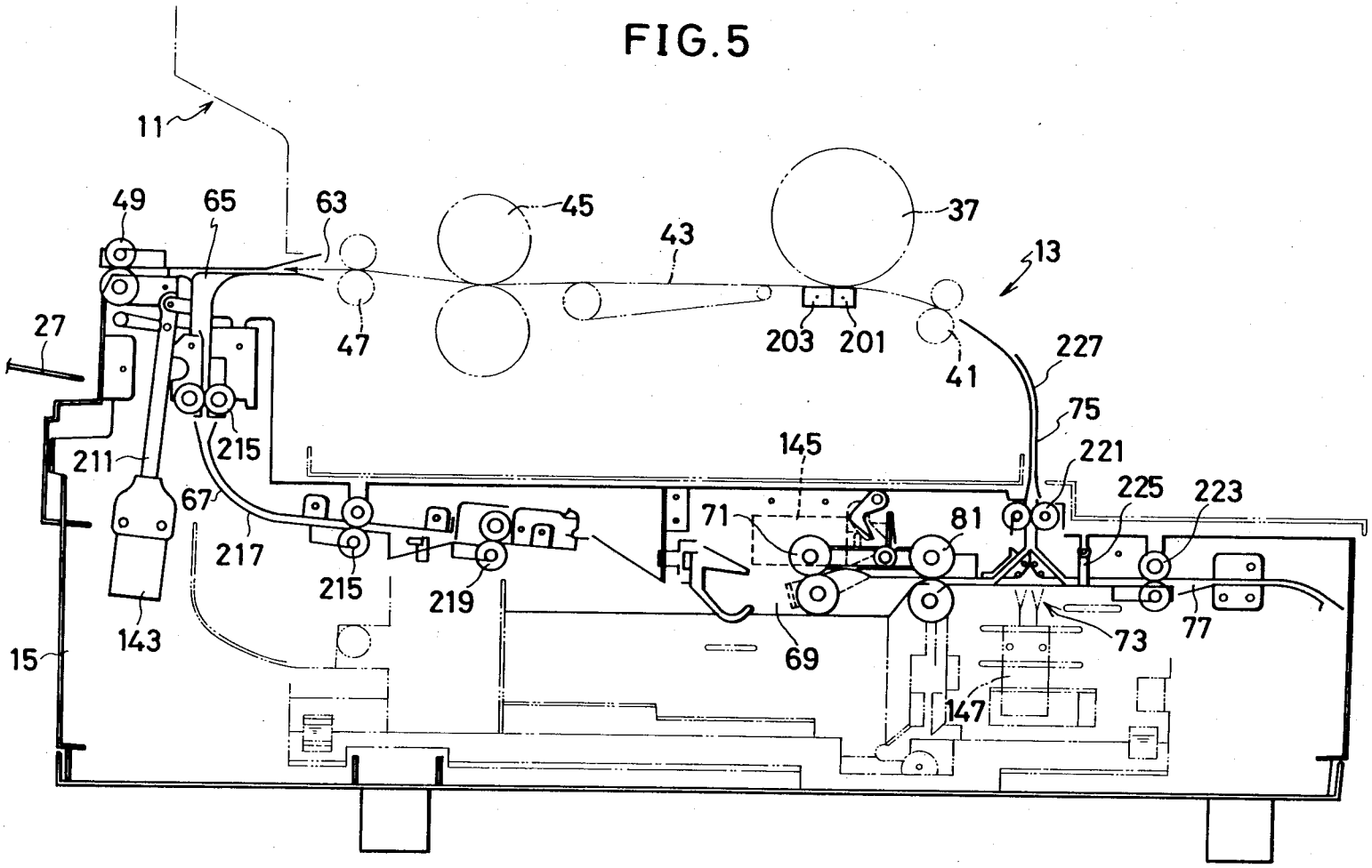
FIG. 5 is a sectional view for illustrating a detailed internal structure of the direction converting transportation unit of the copying device shown in FIG. 1.
Figure 6:
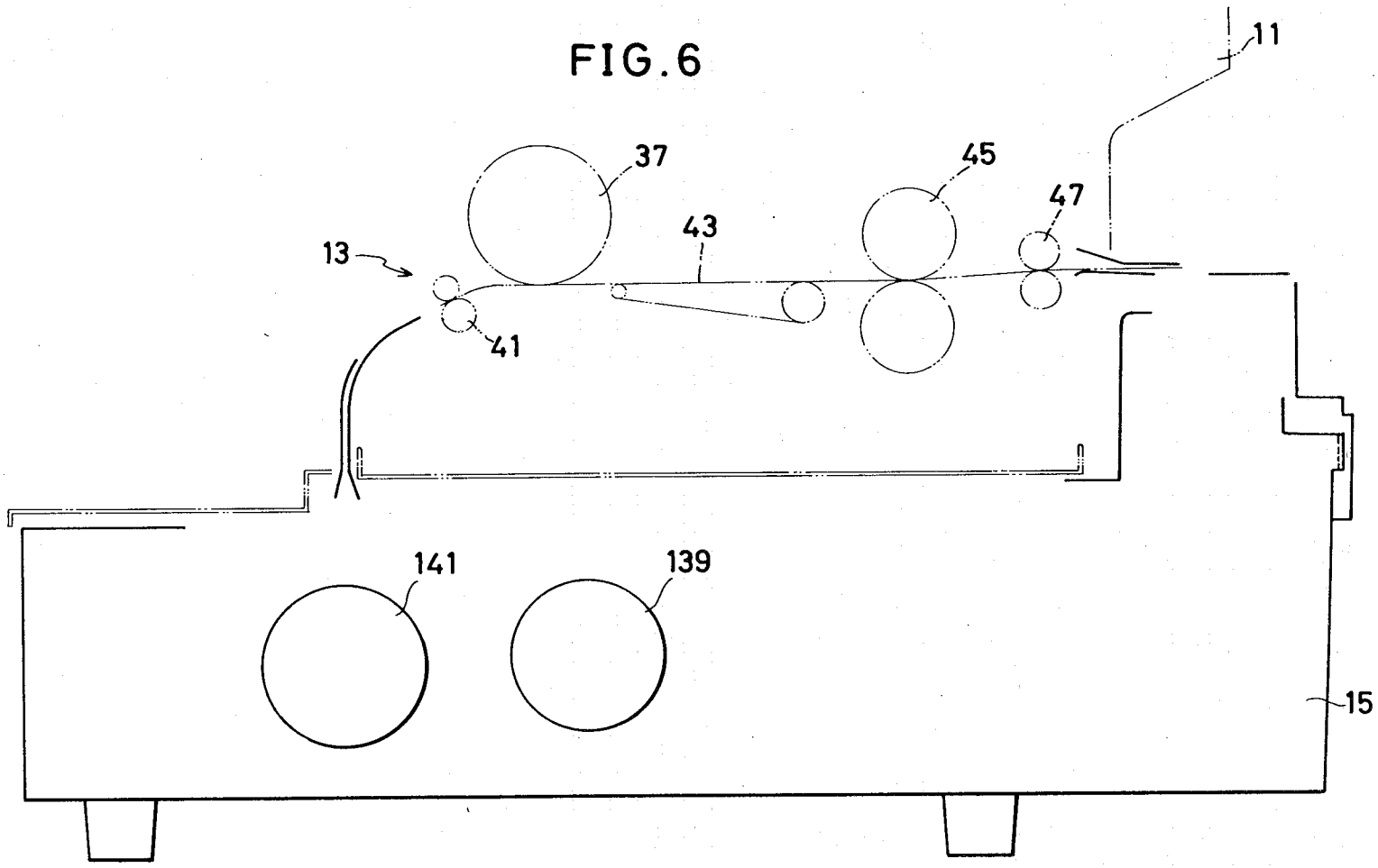
FIG. 6 is a simplified sectional view of the direction converting transportation unit of FIG. 5 as seen from the opposite side.

Referring to FIGS. 5 and 6, the direction converting transportation unit 15 will be described in detail next.

As mentioned earlier, a copying paper P' which is ejected from the ejecting rollers 47 of the copying 13 is ejected to the ejected paper tray 27 under the control of the first sorting gate unit 65 or is ejected vertically downward toward the first turning over route 67. The control of a copied P' by the first sorting gate unit 65 to eject it to either one of the two possibilities is carried out by the first sorting solenoid 143 that is connected to the first sorting gate unit 65 via the linking member 211. The first sorting solenoid 143 is controlled by the first sorting solenoid controlling signal $S_3$ from the microcomputer 105, as shown in FIG. 9. A copied paper P' which is ejected from the ejecting rollers 47 toward the first turning over route 67 via the first sorting gate unit 65, under the control of the first sorting solenoid 143, is transported to bringing-out rollers 219 via a plurality of conveyor rollers 215 and a conveyor guide 217 to the temporary collecting unit 69 to be collected there. Now, suppose, for example, that after the image of the first surface of a desired number of sheets of manuscripts A tht are placed on the manustript stand 17 of the automatic manuscript supply unit 11 is copied on the first surface of each of equal number of copying papers, the image of the second surface of the manuscripts A is to be copied either on the second surface of each of the copied paper P' as a two-sided copying, or on the same first surface of each of the copied paper P' as a multiple copying. Then, all of the copied papers P' that have the copied images exclusively on each of their first surfaces, are sent under the control of the first sorting gate unit 65 successively, from the ejecting rollers 47 of the copying unit 13 via the first turning over route 67, to the temporary collecting uniut 69 to be collected there.

The copying papers with copied image on their one sides that are collected in this manner in the temporary collecting unit 69 are taken out sheet by sheet from the temporary collecting unit 69 by means of the take-out rollers 71. The take-out rollers 71 are driven by a take-out roller driving solenoid 145 situated above the rollers 71 so as to establish a contact with the copied papers P' that are collected in the temporary collecting unit 69, to take out the copied papers P' one sheet at a time. The take-out roller driving solenoid 145 is controlled by a take-out roller controlling signal $S_f$ from the microcomputer 105, as shown in FIG. 9. A copied paper P' that is taken out from the temporary collecting unit 69 by the take-out rollers 71 is supplied to the second sorting gate unit 73 by the bringing-in rollers 81. The copied paper P' is either sent into the second turning over route 75 that extends upward from the gate unit or sent into the front-back converting route 77 that extends horizontally from the second sorting gate unit 73, under the control of the second sorting gate unit 73, as mentioned earlier. The sec sorting unit 73 is controlled by a second sorting solenoid 147 tat is provided underneath the sorting unit 73. The second sorting solenoid 147 is controlled in turn by a second sorting solenoid controlling signal S,om the microcomputer as shown in FIG. 9.

A copied paper P' that is sent upward into the second turning over route 75 from the second sorting gate unit 73, is transported further upward along the second turning over route 75 by the conveyor rollers 21. Then, it passes by again the transfer unit 61 which is provided beneath the photosensitive drum 37, via a conveyor guide 227, the aligning rollers 41, and others, to have a multiple copy made on the same first surface. Subsequently, it is ejected to the ejected paper tray 27 via the main conveyor route 43, fixing device 45, ejecting rollers 47, and the auxiliary rollers 49.

On the other hand, a copied paper P' that is sent horizontally into the front-backconverting route 77 from the second sorting gate unit 73, is transported further by the switch-back type conveyor rollers 223. When the rear end of the copied paper P' is detected to have passed the second sorting gate unit 73 by a rear end detecting switch 225, the switch-back type rollers 223 are rotated in reverse direction to transport the copied paper P' in the direction which is opposite to the direction of transportation so far. Then, the rear end of the copied paper P' is transported, upward under the control of the second sorting gate unit 73, toward the second turning over route 75 from the second the second sorting gate unit 73. With this arrangement, the from and the back of the copied paper P' is inverted, and then the copied paper P' passed by the transfer unit 61 with its second surface facing the photosensitive drum 37 to have a copying made on the second surface, that is, a two-sided copying accomplished. Then, it is ejected to the ejected paper tray 27 from the main conveyor route 43 via the fixing device 45, the ejecting rollers 47, and the auxiliary rollers 49.

Now, FIG. 6 is a simplified diagram of the direction converting transportation unit 15 as seen from the other side of FIG. 5. As shown in the figure, the direction converting transportation unit 15 has a first motor 139 and a second motor 141. The first motor 139 is controlled as shown in FIG. 9 by a signal Sma for colling the first motor, and controls the take-out rollers 71 and the bringing-in rollers 81 of the direction converting transportation unit 15. Further, the second motor 141 is controlled for the forward rotation by a signal Smc from the microcomputer 105 for the second motor and for the reverse rotation by a signal Smb for the reverse roation of the second motor, and controls the forward and reverse rotations of the switchback type conveyor roller 223 of the direction converting transportation unit 15.

Figure 7:
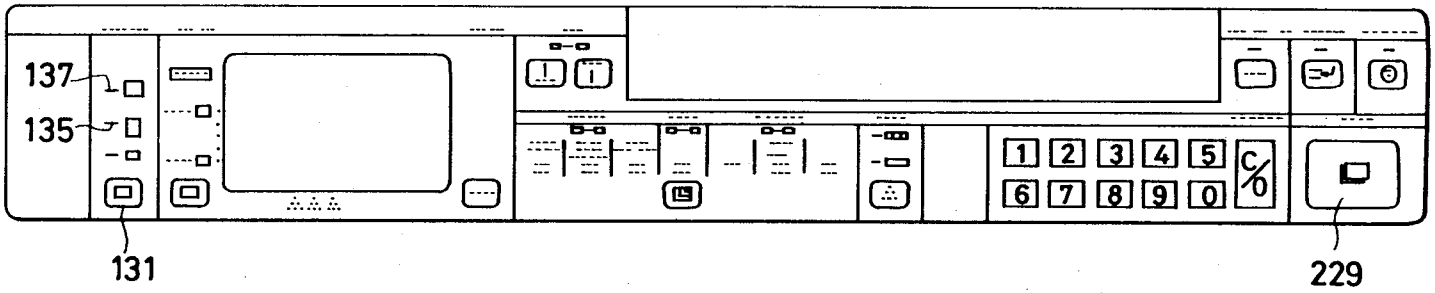
FIG. 7 is a plan view for illustrating the copying unit of the copying device shown in FIG. 1.

FIG. 7 shows the operating unit 85 of the copying unit 13. The operating unit 85 is provided on the front side of the copying unit 13 as shown in FIG. 1. On the right-hand end of the operating unit 85, there is provided a start button 229 by the operation of which the driving motor 109 is actuated to start the copying operation. On the left-hand side of the operating unit 85, there are provided a mode alteration switch 131, a light-emitting diode 135 for displaying two-sided copying mode, and a light-emitting diode 137 for displaying double copying mode. By the operation of the mode alteration switch 131, it becomes possible to designate the two-sided copying mode or the double copying mode, by lighting up the light-emitting diode 135 for displaying two-sided copying mode or the light-emitting diode 137 for displaying double copying mode. When the two-sided copying mode or the double copying mode is designated by the operation of the mode alteration switch 131, the operation of the automatic manuscript supply unit 11 is switched to the SDF mode.

In a system with the above construction, the present copying device has the ADF mode and the SDF mode as the paper feeding methods for the automatic manuscript supply unit 11, and has the two-sided copying mode and the multiple copying mode, in addition to the ordinary one-sided copying mode, as the copying methods in the copying unit 13 and in teh direction converting transportation unit 15.

Immediately after the power switch is turned on, the operating mode of the automatic manuscript supply unit 11 of the present copying device is set automatically to the ADF mode which is displayed by the lighting of the light-emitting diode 119 for displaying automatic feeding operation. When a start button 229 of the operating unit 85 is operated in this condition, the driving motor 109 is actuated under the control of the microcomputer 103 to operate each roller in the automatic manuscript supply unit 11. Then, the feed paper solenoid 121 is actuated by the feed paper solenoid driving signal Sa from the microcomputer 103 via a buffer 111. This actuates the take-out rollers 89 which supply the manuscripts A that are placed on the manuscript stand 17 to the manuscript transporting and collecting unit 97 sheet by sheet starting with the topmost manuscript of the pile. After this, the stop solenoid 127 is brought to the state of actuation by a stop solenoid controlling signal Sd which is sent from the microcomputer 103 via the buffer 117. Then, when a manuscript is on the manuscript placing glass 51 that forms the manuscript placing surface 29, the manuscript will be ejected. After this, the feed paper solenoid 121 is brought to an unactuated state by the control of the microcomputer 103, and the conveyor belt driving solenoid 123 is actuated by a conveyor belt driving signal Sd which comes from the microcomputer 103 via a buffer 113. This actuates in turn the conveyor belt 151 which transports a manuscript that is supplied from the manuscript supply unit 87 to the manuscript placing surface 29. After this, the microcomputer 103 controls the stop solenoid 127 which stops the manuscript at a prescribed position on the manuscript placing glass of the manuscript placing surface 29 by the action of the stopper 161. Now, after the manuscript A which is placed at a prescribed position on the manuscript placing surface 29, and is copied, the manuscript A is ejected to the second manuscript ejecting unit 163 if the switching solenoid 125 is in action due to a switching solenoid driving signal Sc which is supplied from the microcomputer 103 via a buffer 115, where as it is ejected to the first manuscript ejecting unit 19 if the switching solenoid 125 is not in action. In this manner, when a previous manuscript is ejected after completion of copying, a next manuscript is arranged to be supplied automatically under the control of the microcomputer 103.

As mentioned earlier, the copying device is in the ADF mode at immediately after closing of the power source. When the mode alternation switch 131 of the operating unit 85 is operated in this state, the device is switched to the SDF mode with lighting of the light-emitting diode 135 for displaying two-sided copying mode or the light-emitting diode 137 for displaying multiple copying mode. After that, the light-emitting diode 129 for displaying semi-automatic, feeding operation in the operating unit 171 of the automatic manuscript supply unit 11 is also lighted up. When the start button 229 is operated in this state, a manuscript on the manuscript stand 17 is supplied to the manuscript placing surface 29 similar to the previous case, and it is ejected after copying is completed. However, in the SDF mode, the feed paper action of the automatic manuscript supply unit 11 will be interrupted until the next operation of the start button, without operating on its own.

As described in the foregoing, a manuscript is supplied to a prescribed position on the manuscript placing surface 29 by the automatic manuscript supply unit 11, and its copy is taken under the control of the copying unit 13 and the direction converting transportation unit 15. The double copying operation and the two-sided copying operation of the copying operation are carried out by the designation of the two-sided copying mode through the lighting of the light-emitting diode 135 for displaying two-sided copying mode by the operation of the mode alteration switch 131, and by the designation of the double copying mode through the lighting of the light-emitting diode 137 for displaying double copying mode by the operation of the mode alteration switch 131, respectively. In additon, in the case of either of these cases, the feed paper operation is set to the SDF mode by the lighting of the light-emitting diode 120 for displaying semi-automatic feeding operation.

When the start button 229 is operated after the number of sheets of manuscript, magnification, and so forth are operated in the double copying mode, the first sorting gate solenoid 143 by a first sorting solenoid controlling signal Se from the microcomputer 105. This leads a paper P' which has an image copied on one side in the copying unit 13 to the first turning over route 67 from the ejecting rollers of the copying unit 13, and further to the temporary collecting unit 69 by means of a plurality of rollers, a guide, and others, to be collected there. When the copied paper P' is collected in the temporary collecting unit 69, the first sorting solenoid 143 returns to the state of nonaction. By repeating this operation, the desired number of copied papers P' are collected in the temporary collecting unit 97.

If the start button 229 is operated after the desired number of copying papers P' that have images copied on one side of the papers are collected in the temporary collecting unit 69, and manuscript to be doubly copied on the same side of the papers is set, the take-out roller driving solenoid 145 is actuated by a take-out roller controlling signal Sf from the microcomputer 105, and the tape-out roller driving solenoid 145 is lowered to take out a copied paper P collected in the temporary collecting unit 69. At the same time, a second sorting solenoid controlling signal Sg from the microcomputer 105 controls the second sorting solenoid 147 to direct the copied paper P' from the temporary collecting unit 69 to proceed from the second sorting gate unit 73 to the second turning over route 75 without proceeding to the front-back conversion route 77. In addition, the first motor 139 is rotated by a first motor controlling signal Sma from the microcomputer 105 to drive to rotate the take-out rollers 71, the bringing-in rollers 81, and others. The second motor 141 is also rotated by a second motor controlling signal Smc from the microcomputer 105 to drive to rotate the conveyor rollers 221 and others, to take out one by one the copied papers P'. When the tip of the copied paper P' reaches the bringing-in rollers 81, the take-out driving solenoid 145 returns to their normal positions, raising the take-out rollers 71. When the tip of the copied paper P' reaches the conveyor rollers 221, the bringing-in rollers 81 are stopped under the control of the microcomputer 105. However, the bringing-in rollers 81 are equipped with a one-directional clutch so that the copied paper P' is transported under the pulling of the conveyor rollers 221. When the tip of the copied paper P' reaches the aligning rollers 41 that are placed before the transfer unit 61 of the copying unit 13, the second motor 141 and the conveyor rollers 221 are stopped under the control of the microcomputer 105. The copied paper P' is supplied to the transfer unit 61 of the copying unit 13 by being further transported while arranged by the aligning rollers 41, and an image is copied doubly on the same side of the paper where a copy was already made previously at the transfer unit 61. The copying paper P which is doubly copied in this way is ejected to the ejected paper tray 27 via the main transportation route 43 the fixing device 45, the ejecting rollers 47, and the auxiliary rollers 49. The operation described in the above is repeated until the desired number of papers with an image copied on their one sides that are collected in the temporary collecting unit 69 are exhausted.

The operation for the two-sided copying differs from that of the double copying explained above only in that the copied papers P' that were collected in the temporary collecting unit 69 under the control of the second sorting gate unit 73 are transported first, instead of transported directly to the second turning over route 75 from the temporary collecting unit 69, then transported in the reverse direction, and from there further to the second turning over route 75 in order to invert the front and the back of the copied papers P'.

In other words, along with the lowering of the take-out rollers 71 due to a take-out roller controlling signal Sf from the microcomputer 105, by the operation of the production of the start button after the copied papers P' are collected in the temporary collecting unit 69, the second sorting solenoid 147 is controlled by a second sorting solenoid controlling signal Sg from the microcomputer 105. By this arrangement, the second sorting gate unit 73 causes the copied papers P' from the temporary collecting unit 69 to be transported to the front-back conversion route 77, instead of transporting them directly to the second turning over route 75. Further, the first motor 139 is rotated by a first motor controlling signal Sma from the microcomputer 105, to drive to rotate the take-out rollers 71 and the bringing-in rollers 81, and also, the second motor 141 is arranged to be rotated to rotate the switch-back type conveyor rollers 223 by a second motor controlling signal Smc from the microcomputer 105. As a result, a copied paper P' which is taken out by the take-out rollers 71 and transported by the bringing-in rollers 81, is transported passed the second sorting gate unit 73 toward the front-back conversion route 77, and is further transported to the inside of the front-back conversion route 77 by means of the switch-back type conveyor rollers 223. Here, when the tip of the copied paper P' reaches the switch-back type conveyor rollers 223, the first motor 139 is stopped and the bringing-in rollers 81 are stopped also. When the rear end of the copied paper P' passes by the rear end detector switch 225, it is detected by the microcomputer 105 which causes the second motor 141 to reverse the direction of rotation by a second motor reverse rotation controlling signal Smb from the microcomputer 105. By this arrangement, the rotation of the switch-back type conveyor rollers 223 is reversed so that the switch-back type conveyor rollers 223 starts to transport the copied paper P' which had been transported toward the interior of the front-back conversion route 77 in the opposite direction of pulling it from the front-back conversion route 77, namely, toward the second sorting gate unit 73. At the same time, the second sorting solenoid 147 is controlled by a second sorting solenoid controlling signal Sg from the microcomputer 105, and the second sorting gate unit 73 leads the copied paper P' that is transported from the front-back conversion route 77 by means of the switch-back type conveyor rollers 223, toward the second turning over route 75. As a result, the copied paper P' is transported along the second turning over route 75 with the front and the back inverted, and is supplied to the transfer unit 41 of the copying unit 13 via the aligning rollers 41, and an image is copied on one surface of the copying paper P which has an image already copied on the other surface. A copying paper P which has images copied on both sides is ejected to the ejected paper tray 27 via the main transportation route 43, as mentioned ealier. The above operation is continued until the copied papers P' that are collected in the temporary collecting unit 69 are exhausted.

Figure 10:
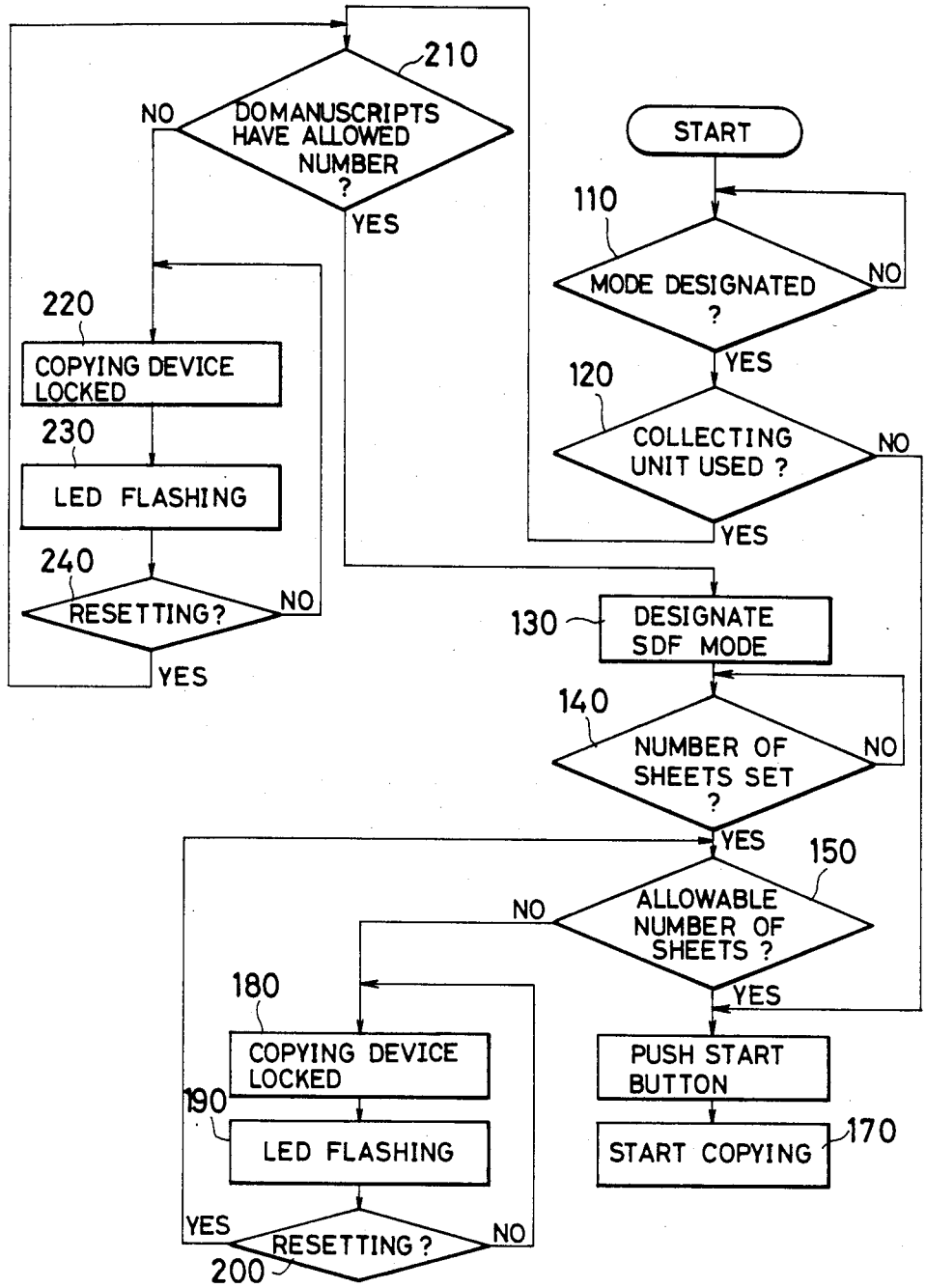
FIG. 10 is a flow chart for illustrating the operation of the copying device shown in FIG. 2.

FIG. 10 is a flow chart which illustrates the operation of one embodiment of the present invention.

In the figure, when the copying mode is designated by the mode alternation switch 131 (step 110), the designated copying mode is judged whether or not it is a two-sided copying mode or a double copying mode that makes use of the temporary collecting unit 59 (step 120). If it is a two-sided copying mode or a double copying mode, it proceeds to step 210, and if it is not, it proceeds to step 160 which is the waiting state for the operation of the copy start button, in preparation to copying (step 120).

In state 210, whether or not the number of sheets of the manuscripts A placed on the manuscript stand 17 exceeds the allowable collecting number of sheets in the temporary collecting unit 69, based on the reading of the state signal by the manuscript detection switch 231. As a result of judgement, if it is found that it does not exceeds the allowable number of sheets, it proceeds to step 130 in order to make it possible to start copying, by the semi-automatic supply mode, based on the judgment that for that number of sheets of manuscripts there exists no fear of generating a jamming of papers in the temporary collecting unit 69. On the contrary, if it exceeds, copying is forbidden by regarding that there will be generated a jamming of papers in copying for that condition, and a light-emitting diode (LED) is flashed to inform the operator of the condition (step 220). If there is detected, after this, that some kind of measure, such as a reduction in the number of sheets of manuscripts, is taken by the operator, it goes back to step 210 to execute a similar processing for the placed manuscripts that reflect the measure by the operator.

On the other hand, after the SDF mode is set in step 130, the number of sheets for two-sided copying or multiple copying is set by the operating button in the operating unit 85 of the copying unit 13. Then, whether or not the set number of sheets is within the allowable number of sheets in the temporary collecting unit 69, in other words, whether or not the total number of sheets that is computed by taking set number of copies of each one of the manuscripts A that are placed on the manuscript stand 17, is less than the maximum collectable number of sheets in the temporary collecting unit 69, is checked (step 150). If the set number of sheets is within the allowable number of sheets, the copying operation is started by the operation of the start button 229 of the operating unit 85, by regarding that there will not be generated a jamming of papers.

On the contrary, if the set number of sheets exceeds the allowable number of sheets, the copying device is locked, and the operator is warned of it by the flashing of LEDD (steps 180 and 190), obstructing the copying operation. In this case, if the operator revises number of sheets (step 200), it goes back again to step 150 to check it again, and the copying operation will be executed only when the set number of sheets is within the allowable number of sheets. As a result, there will never the collected a number of copied papers P' that exceeds the prescribed number of sheets so that the copying device will not generate a jamming of papers.

Further, in the flow chart shown in the figure, when the temporary collecting unit 69 of the direction converting transportation unit 15 is to be made use of for carrying out a two-sided copying or a multiple copying, by setting the supply operation in the automatic manuscript supply unit 11 to the semi-automatic supply operation, that is, to the SDF mode, it is mode possible to set the number of sheets of the manuscripts to be collected in the temporary collecting unit 69 so as not to exceed the allowable number of sheets to prevent a jamming of papers, as well as it is made possible for the operator to select freely between the two-sided copying and the multiple copying.

Figure 11:
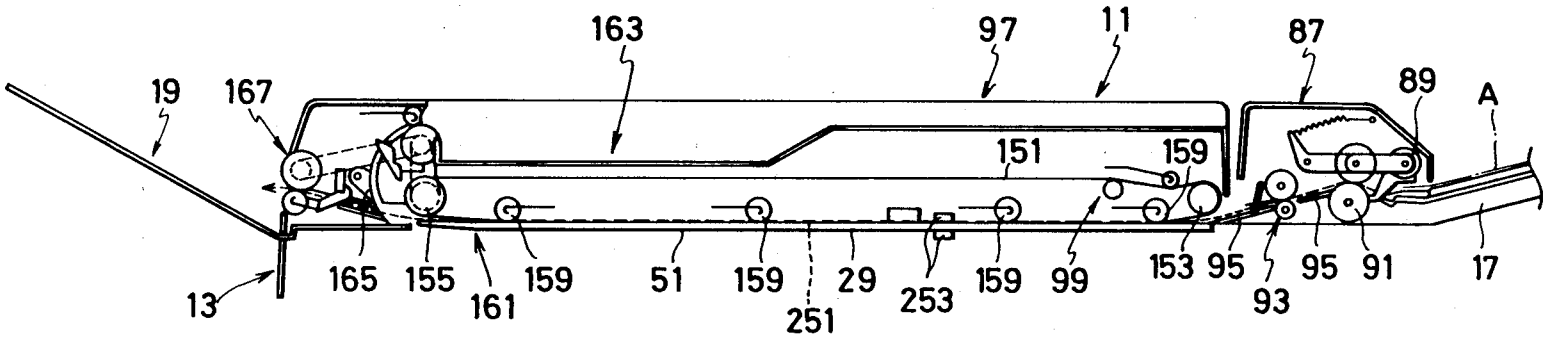
FIG. 11 is a sectional view for illustrating the automatic manuscript supply unit in a modification to the first embodiment.
Figure 12:
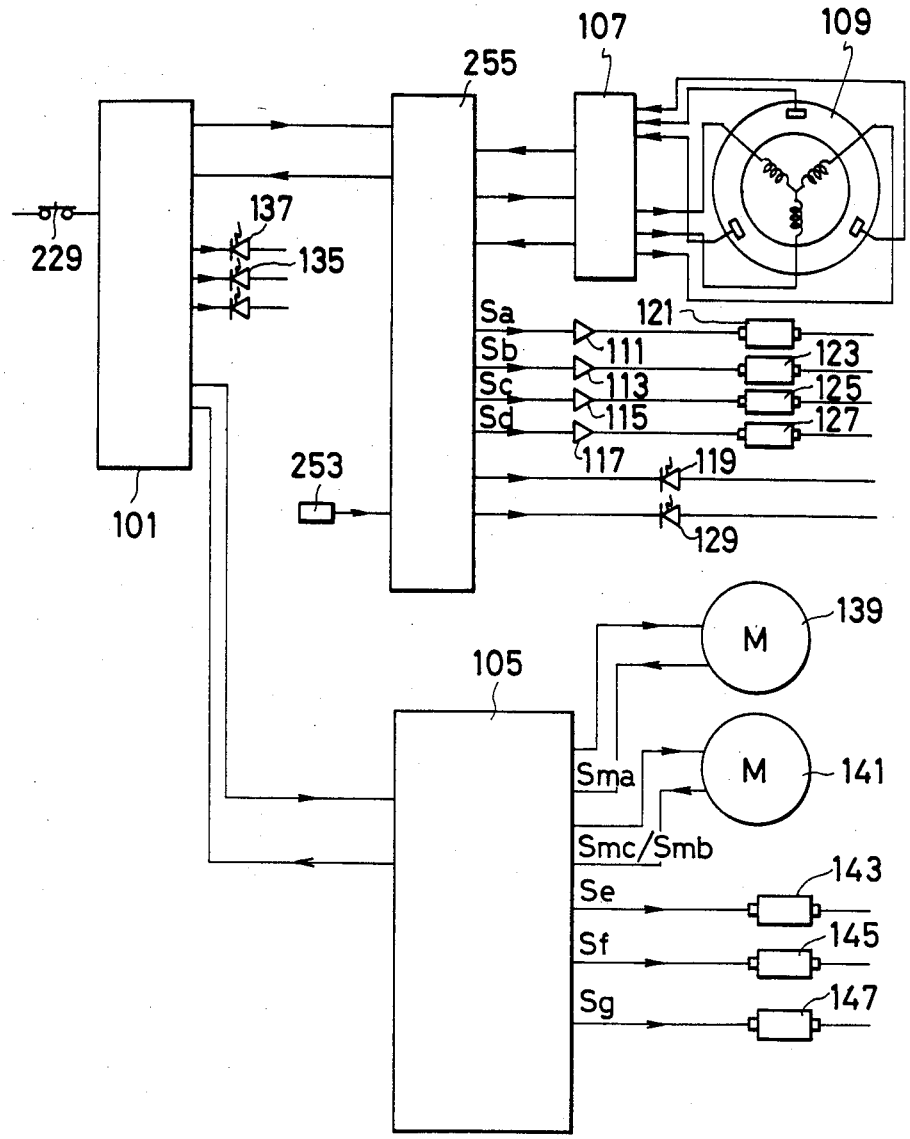
FIG. 12 is a circuit diagram for the modification shown in FIG. 11.

Referring to FIGS. 11 and 12, a modification to the embodiment shown in FIG. 2 is illustrated. The modification consists of an optical sensor 253 that is arranged on a manuscript transporting path 251 of the manuscript transporting and collecting unit 97 for counting the number of sheets of manuscripts in transportation. Further, in order to compute the total number of copying papers required in a two-sided copying or a multiple copying that makes use of the temporary collecting unit 69, a microcomputer 255 shown in FIG. 12 receives a signal that shows the number of sheets of manuscripts present from the optical sensor 253, as well as the signal that indicates the number of copies to be taken, that is set by the operating button in the operating unit 85. At the point in time when the computed total number of sheets exceeds the prescribed maximum number of sheets that are collectable in the temporary collecting unit 69, it is programmed that a signal is output to forbid copying. Here, other configuration is similar to that of the first embodiment so that further explanation will be omitted by assigning identical reference numbers to the corresponding components. Therefore, in this modification, too, there will not occur a collection of copied papers P' that exceeds a prescribed number of sheets in the temporary collecting unit 69, so that no jamming of paper in the copying device will be generated.

Figure 13:
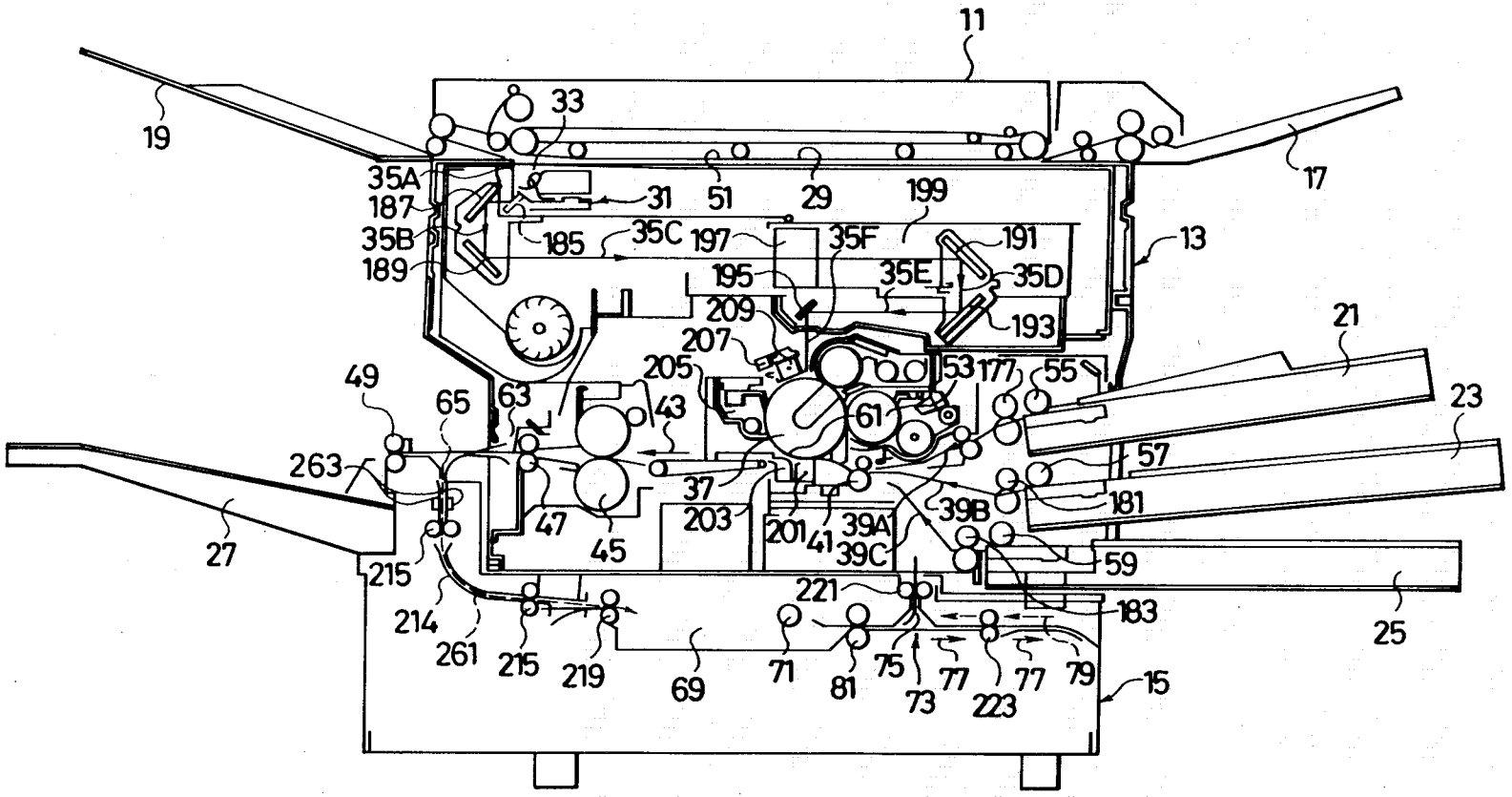
FIG. 13 is a sectional virew of a second embodiment of the copying device in acccordance with the present invention.
Figure 14:
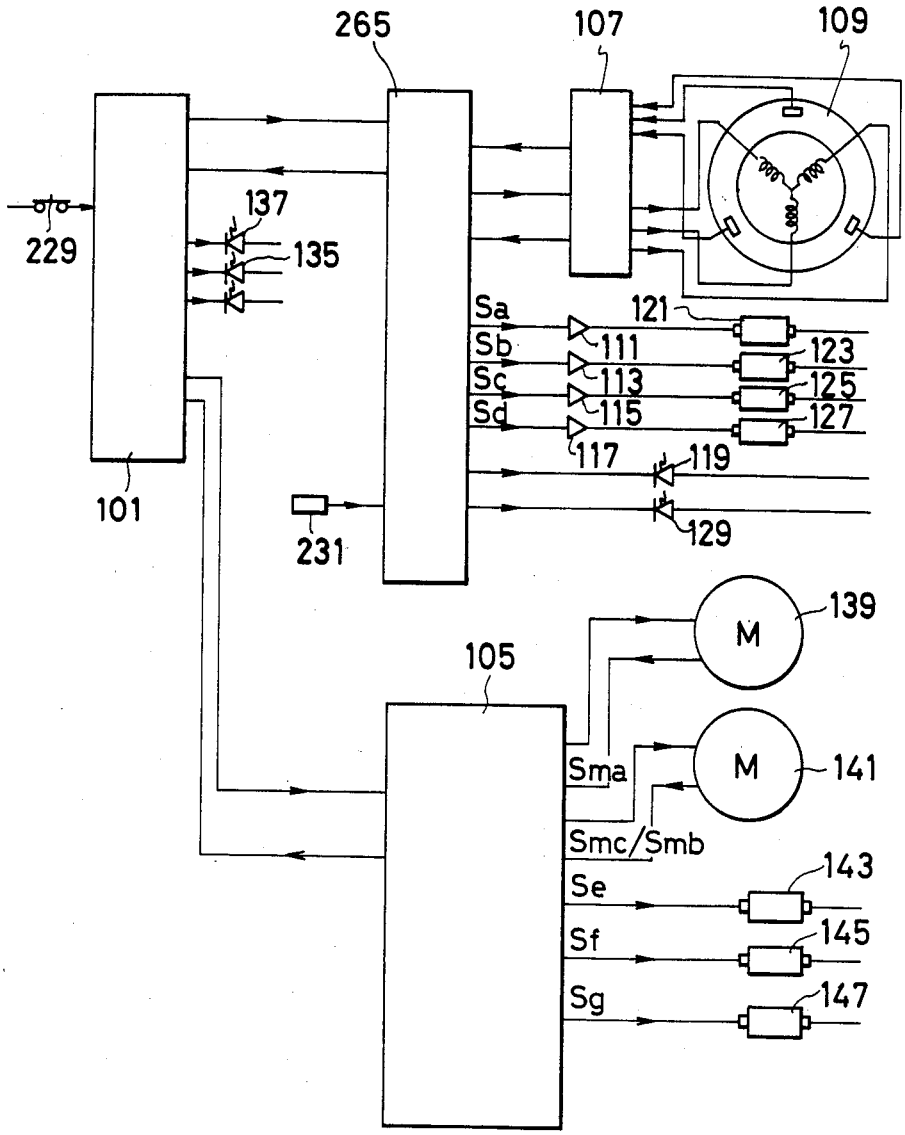
FIG. 14 is a circuit diagram for the second embodiment shown in FIG. 13.
Figure 15:
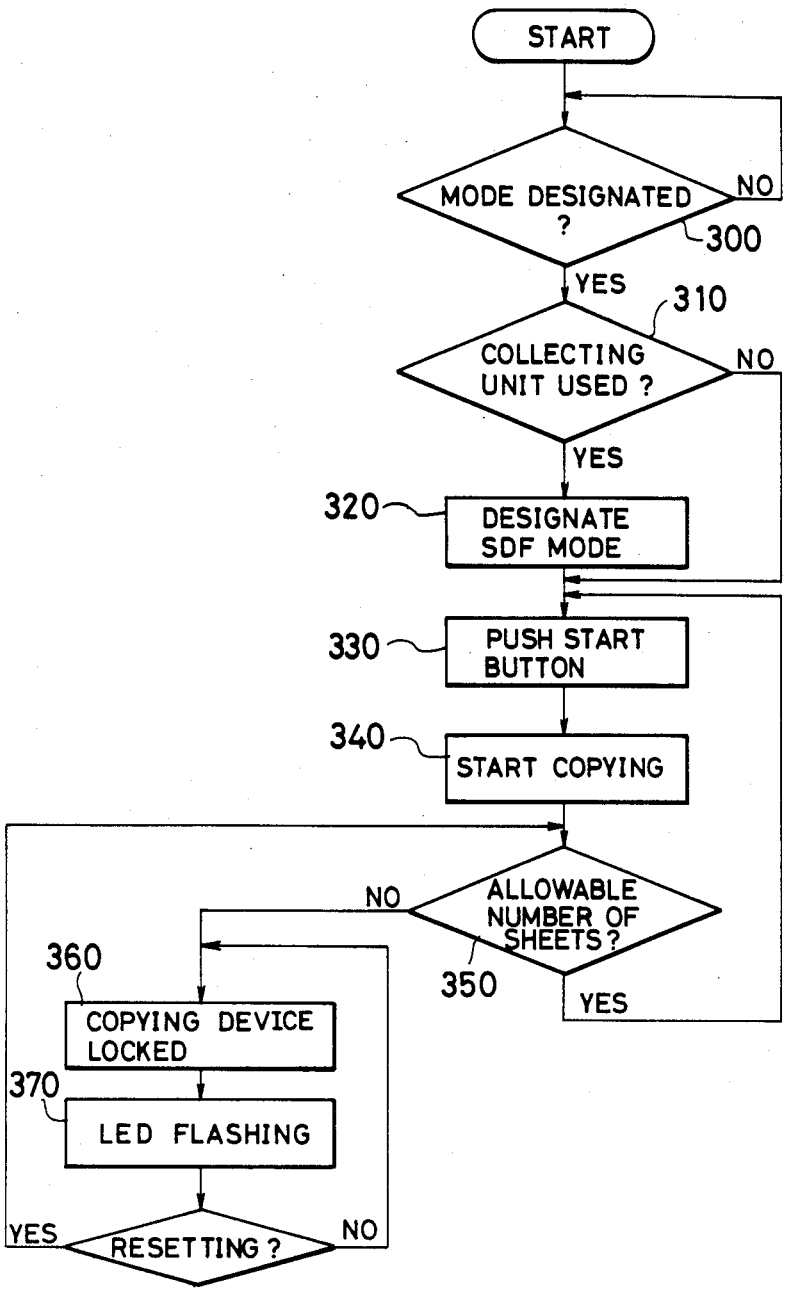
FIG. 15 is a flow chart for illustrating the operation of the second embodiment shown in FIG. 13.

Referring to FIGS. 13, 14, and 15, there are shown a second embodiment of the copying device in accordance with the present invention. As shown in FIG. 13, in the second embodiment, in place of the manuscript detecting, on the conveyor path 261 for transporting copying papers to the temporary collecting unit 69 there is arranged an optical sensor 263 for detecting the number of copying papers that are sent to the temporary collecting unit 69.

As shown in FIG. 14, a microcomputer 265 receives from the optical sensor 263 a signal that indicates the number of copying papers that are transported to the temporary collecting unit 69 in a two-sided copying or a multiple copying that makes use of the temporary collecting unit 69. At the point in time when the number of sheets of the copying papers exceeds a prescribed number of sheets that is obtained by subtracting a marginal number of sheets from the maximum collectable number of sheets in the temporary collecting unit 69, it is programmed to output a signal for forbidding the copying operation. Further, other configuration is similar to the case in the first embodiment so that same symbols are given to the same components to omit explanation.

Next, referring to the flow chart in FIG. 15, the operation of the second embodiment will be described.

In the figure, when first the copying mode is designated by the mode alteration switch 131 (step 300), it is judged whether or not the designated copying mode is a two-sided copying mode or a multiple copying mode that makes use of the temporary collecting unit 69 (step 310). If it is a two-sided mode or a multiple copying mode, it proceeds to step 320. On the other hand, if it is not, it proceeds to step 320 which is a state waiting for operation that is indicated by the copying start button, preparing for an immediate execution of copying.

In step 320, the SDF mode is designated in order to make the start of copying by the semi-automatic supply possible. Then, by operating the start button 229 of the operating unit 85, the copying operation is started (steps 330 and 340). Next, in step 350, number of sheets of copying papers to be transported to the temporary collecting unit 69 is judged, whether or not it exceeded a prescribed number of sheets that is obtained by subtracting a marginal number of sheets from the maximum collectable number of sheets in the temporary collecting unit 69. Then, if the number of sheets of the copying papers required exceeds the prescribed number of sheets, copying is forbidden by regarding that there will be generated a jamming of papers, and at the same time, LED is flashed to inform of it to the operator (steps 360 and 370).

Further, if the number of copying papers required does not exceed the prescribed number of sheets, start of copying is made possible by regarding that there is no fear of generating a jamming of papers, and returns to step 330.

Therefore, in the second embodiment, too, there will not be collected copying papers P' that will exceeds the prescribed number of sheets in the temporary collecting unit 69, so that there will not be generated a jamming of papers in the copying device.

In summary, according to the present invention, it is arranged to forbid the starting of copying if, the start of a two-sided copying or a multiple copying, the number of sheets of copying papers that are to be collected in a collecting unit exceeds an allowed number of collectable sheets in the collecting unit. Therefore, it can surely prevent a jamming of papers caused by the collection of copying papers in the collecting unit that exceeds the allowed number of sheets.

Various modifications will become possible for those skilled in the art after receiving the teachings of the present disclosure without departing from the scope thereof.

What is claimed is:

1. A copying device which has a document supply unit for supplying documents to be copied in an automatic or a semi-automatic fashion, and a two-sided or a multiple copying mechanism that supplies the copy papers again to a image copy unit after they are collected in a temporary collecting unit, for carrying out a two-sided copying or a multiple copying, comprising:

(a) means for detecting the numbers of the documents;

(b) means for computing the number of copy papers to be collected in the temporary collecting unit in accordance with the number of documents detected by said detecting means when the two-sided copying or the multiple copying is to be carried out; and (c) means for controlling the copying device so as to forbid the copying operation when the number of the copy papers computed by said computing means exceeds a predetermined allowed collections number of copy papers in the temporary collecting unit.

2. A copying device as claimed in claim 1, in which said controlling means further controls the document supply means so as to supply the documents semi-automatically when a two-sided copying or a multiple copying is to be carried out.

3. A copying device as claimed in claim 1, in which said computing means computes the number of the copy papers that are to be collected in the temporary collecting unit by multiplying the number of the documents with a set number of copies to be taken.

4. A copying device as claimed in claim 1, in which said document number detecting means comprises a switch that is arranged in the above of the entrance of the document supply unit for detecting the thickness of the documents, that are placed on the documents stand, that corresponds to the number of the documents.

5. A copying device as claimed in claim 1, in which said document number detecting means comprises an optical sensor that is disposed on a document transporting path for counting the number of of the documents in transportation.

6. A copying device as claimed in claim 1, in which said computing means and controlling means comprise a microcomputer.

7. A copying device which has a document supply unit for supplying the documents to be copied in an automatic or a semi-automatic fashion, and a two-sided or a multiple copying mechanism that supplies the copy papers again to the image copying unit after they are collected in a temporary collecting unit, for carrying out a two-sided copying or multiple copying, comprising;

(a) means for detecting the number of the copy papers to be sent to the temporary collecting unit; and (b) means for controlling the copying device so as to forbid the copying operation when the number of the copy papers to be transported to the temporary collecting unit exceeds a prescribed number of copy papers allowed in the temporary collecting unit.

8. A copying device as claimed in claim 7, in which said controlling means controls the document supply unit so as to supply the documents semi-automatically when a two-sided copying or a multiple copying is to be carried out.

9. A copying device as claimed in claim 7, in which said detecting means comprises an optical sensor that is disposed on the transporting route of the copying papers to the temporary collecting unit for detecting the number of sheets of the copying papers that are transported to the temporary collecting unit.

10. A copying device as claimed in claim 7, in which said controlling means comprises a microcomputer that is programmed so as to output a command to forbid the copying operation when the number of the copy papers to be transported to the temporary collecting unit exceeds a prescribed number of copy papers allowed in the temporary collecting unit.

11. A copying device which has a document supply unit for supplying the documents to be copied in an automatic or a semi-automatic fashion, and a two-sided and a multiple copying mechanism that supply the copy papers again to the image copying unit after they are collected in a temporary collecting unit, for carrying out a two-sided copying and a multiple copying, comprising:

(a) means for controlling the document supply unit so as to supply the manuscripts semi-automatically for the case of a two-sided copying and a multiple copying.

12. A copying device as claimed in claim 11, further comprising:

(b) detecting means for detecting the number of the documents; and (c) means for computing the number of the copy papers to be collected in the temporary collecting unit, according to the number of the documents detected by said detecting means when the two-sided copying or the multiple copying is to be carried out, (d) said controlling means further controls the copying device to forbid the copying operation when the number of the copy papers computed by said computing means exceeds an allowed collecting number of sheets that is predetermined.

13. A copying device as claimed in claim 12, in which said, computing means computes the number of sheets of the copy papers to be collected in the temporary collecting unit by multiplying the number of the documents with a set number of copies to be taken.

14. A copying device as claimed in claim 12, in which said document number detecting means comprises a switch that is arranged in the entrance of the document supply unit for detecting the thickness of the documents corresponding to the number of the documents that are placed on the document stand.

15. A copying device as claimed in claim 12, in which said document number detecting means comprises an optical sensor that is disposed on the document transporting route for counting the number of the documents in transportation.

16. A copying device as claimed in claim 12, in which said computing means and controlling means comprise microcomputers.

17. A copying device which has a two-sided or a multiple copying mechanism that supplies the copy papers again to the image copying means after they are collected in a temporary collecting means, for carrying out a two-sided copying or multiple copying, comprising:

(a) means for detecting the number of the copy papers to be sent to the temporary collecting means; and (b) means for controlling the copying device so as to forbid the copying operation when the number of the copy papers to be transported to the temporary collecting means exceeds a predetermined allowed collecting number of sheets in the temporary collecting means.

18. A copying device as claimed in claim 17, in which said detecting means comprises an optical sensor that is disposed on the transporting route of the copy papers to said temporary collecting means for detecting the number of the copy papers that are transported to said temporary collecting means.

19. A copying device as claimed in claim 17 in which said controlling means comprises a microcomputer that is programmed so as to output a command to forbid the copying operation when the number of the copy papers to be transported to said temporary collecting means exceeds a predetermined allowed collecting number of copy papers in said temporary collecting means.

20. A copying device which has a two-sided or a multiple copying mechanism that supplies the copy papers again to the image copying means after they are collected in a temporary collecting means, for carrying out a two-sided copying or multiple copying, comprising:

(a) means for detecting the number of the copy papers to be sent to the temporary collecting means; and (b) means for displaying a warning;

(c) means for controlling the copying device as to operate said warning displaying means when the number of the copy papers to be transported to said temporary collecting means exceeds a predetermined allowed collecting number of copy papers in said collecting means.

21. A copying device as claimed in claim 20, in which said detecting means comprises an optical sensor that is disposed on the transporting route of the copying papers to the temporary collecting means for detecting the number of the copy papers that are transported to said temporary collecting means.

22. A copying device as claimed in claim 20, in which said controlling means comprises a microcomputer that is programmed so as to output a command to operate said warning displaying means when the number of the copy papers to be transported to the temporary collecting means exceeds a predetermined allowed collecting number of copy papers in said temporary collecting means.

23. A copying device as claimed in claim 20, in which said controlling means comprises a microcomputer that is programmed so as to output a command to forbid the copying operation after the warning is displayed by said warning displaying means.

24. A copying device which has a two-sided or a multiple copying mechanism that supplies the copy papers again to the image copying means after they are collected in a temporary collecting means, for carrying out a two-sided copying or multiple copying, comprising:

(a) means for setting the number of copy papers;

(b) means for determining a number of copy papers in accordance with the set number;

(c) means for displaying a warning when the determined number of copy papers exceeds a predetermined allowed number;

(d) means for controlling so as to operate said warning displaying means when the number of the copy papers to be transported to said temporary collecting means exceeds a predetermined allowed collecting number of copy papers in said temporary collecting means.

25. A copying device as claimed in claim 24, in which said controlling means comprises a microcomputer that is programmed so as to output a command to operate said warning displaying means when the number of the copy papers to be transported to the temporary collecting means exceeds a predetermined allowed collecting number of copy paper in said temporary collecting means.

26. A copying device as claimed in claim 24, in which said controlling means comprises a microcomputer that is programmed so as to output a command to forbid the copying operation after the warning is displayed by said warning displaying means.

* * * * *